United States Patent [19]

Levy

[11] Patent Number: 4,700,048

[45] Date of Patent: Oct. 13, 1987

[54] HEATING ATTACHMENT FOR TOWELETTES

[76] Inventor: Nathan Levy, 315 W. 19th St., New York, N.Y. 10011

[21] Appl. No.: 857,365

[22] Filed: Apr. 30, 1986

[51] Int. Cl.[4] ..... H05B 3/06

[52] U.S. Cl. ..... 219/214; 219/386; 219/521; 221/150 A

[58] Field of Search ..... 219/214, 274, 385, 386, 219/521, 552, 535, 301; 221/150 R, 150 A; 222/146.5; 239/133, 134, 135, 136

[56] References Cited

U.S. PATENT DOCUMENTS

| | | | |
|---|---|---|---|
| 1,488,201 | 3/1924 | Glasco | 219/214 |
| 2,142,599 | 1/1939 | Binder | 219/552 |
| 2,527,101 | 10/1950 | Maddox | 219/214 |
| 2,604,573 | 7/1952 | Raines | 219/552 |
| 3,069,528 | 12/1962 | Gardner | 219/214 |
| 3,391,633 | 7/1968 | Boosalis | 99/357 |
| 3,578,945 | 5/1971 | Ayres | 219/214 |
| 3,584,605 | 6/1971 | Schwartz | 219/385 |
| 3,644,707 | 2/1972 | Costello | 219/302 |
| 3,710,978 | 1/1973 | Cosby | 221/150 A |
| 3,827,736 | 8/1974 | Mango | 219/214 |
| 3,849,629 | 11/1974 | Graham | 219/342 |
| 4,004,711 | 1/1977 | Ravich | 221/63 |
| 4,084,080 | 4/1978 | McMahan | 219/401 |
| 4,163,896 | 8/1979 | McAvinn | 219/525 |
| 4,289,253 | 9/1981 | Andersson | 221/1 |
| 4,495,402 | 1/1985 | Burdick | 219/214 |

*Primary Examiner*—E. A. Goldberg
*Assistant Examiner*—Teresa J. Walberg
*Attorney, Agent, or Firm*—James & Franklin

[57] ABSTRACT

An attachment for a towelette container provides a path through which the towelettes pass as they are removed from the container and a heater warms the towelettes as they are in and move through the path. The attachment is detachably secured to the container so that it can be used on new containers as the original containers become depleted of their contents. The heater can be an incandescent bulb and the outer wall of the attachment can be at least partially light-transmissive, so that the attachment can also function as a lamp or night light.

14 Claims, 4 Drawing Figures

HEATING ATTACHMENT FOR TOWELETTES

This invention relates to an attachment for a towelette container which warms the towelettes as they are removed from the container.

Containers for a plurality of flexible elements from which the elements may be removed one after the other are in common use. In one particular embodiment the flexible elements are in the form of moist towelettes used for baby hygiene. Because the towelettes are moist, usually as a result of the presence in them of liquids which tend to evaporate rapidly, the towelettes when applied to the skin have a very marked cooling effect. While for adults this may often be considered pleasant, for infants the sudden application of a cooling towelette is unsettling and frequently leads to distress. It therefore is desirable to provide a means for warming the towelettes before they are applied to the baby's skin, thereby to avoid any undesirable shock.

Customarily the towelettes are sold in plastic containers having a removable top with an opening through which the towelettes can pass, the removal of one towelette by pulling it through that opening bringing the next succeeding towelette to a position where its leading end passes through the opening and is left in a position to be grasped and pulled when the next towelette is desired. The individual containers are disposable once they have been emptied of their contents, but they are self-sustaining structures.

In accordance with the present invention I provide an attachment adapted to be removably mounted on such a towelette container so that it can be used on a succession of such containers. The attachment defines a path through which a towelette can pass, which path has a length preferably approximating that of the towelette itself, the leading end of the towelette extending out from the attachment for manual grasping in essentially the same way as the leading end of a towelette normally extends from the container. Heating means is provided in the attachment in heat-transmissive relation to the towelette received in the attachment, thereby to warm the latter. Hence the next towelette to be used is warmed while it is waiting to be used, and the removal of that towelette from the attachment brings the next towelette into the attachment to be warmed.

It is the prime object of the present invention to provide means for warming towelettes or other flexible elements as they are removed from their container and before they are used.

It is another object of the present invention to provide such an attachment which can be used sequentially with a plurality of towelette containers.

It is yet another object of the present invention to provide such an attachment which can also function as a source of illumination and beautification both with and without the container.

To the accomplishment of the above, and such other objects as may hereinafter appear, the present invention relates to an attachment for use with a container for flexible elements as defined in the appended claims and as described in this specification, taken together with the accompanying drawings in which FIG. 1 is a three-quarter perspective view of one embodiment of the present invention in position on a towelette container;

Figure 1:
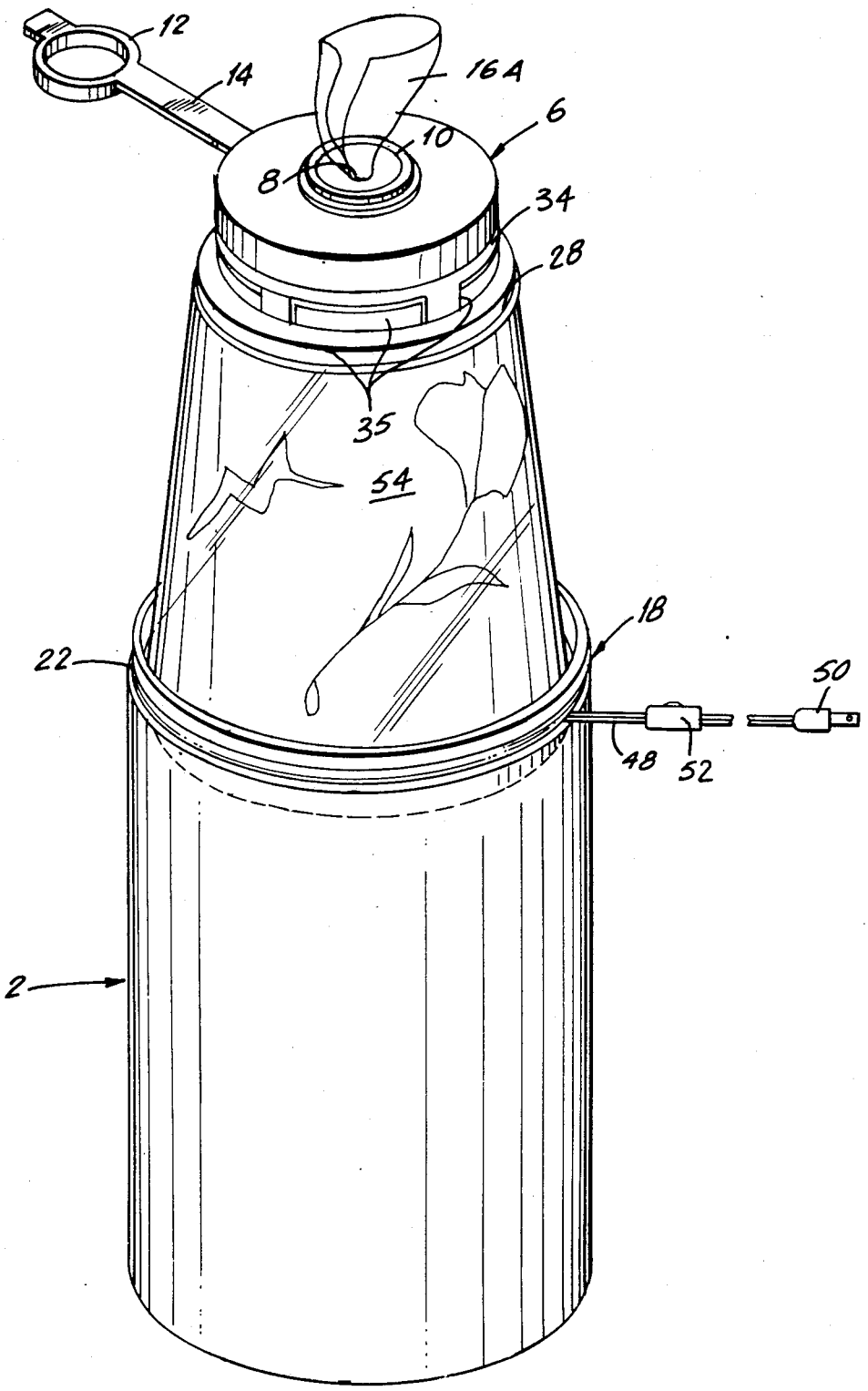

Although, as set forth above, the attachment of the present invention is particularly adapted for use for the warming of moist towelettes, and is here specifically illustrated as used with an existing commercial container for such products, it will be apparent that it can be used for many other types of products, generically characterized as flexible elements. Those elements will be here specifically described as towelettes, but the use of the term towelettes, it will be understood, is exemplary only and not limiting.

A typical towelette container, generally designated 2, is in the form of a large plastic jar having an open top 4 defined by a top rim 5 which is normally closed by a cap 6 which is sealingly but removably secured to the container 2 to close the top 4 and which is provided with an opening 8 surrounded by a rim 10, a sealing top 12 being secured to the cap 6 by a flexible strap 14 and being snap-engageable with the rim 10 so as to seal the opening 8. The towelettes, generally designated 16, are packed in the jar 2 in sequentially connected manner, so that as one towelette 16 is pulled out through a dispensing station at the open jar top opening 8 it will pull the next towelette partially out through that opening, leaving the leading end of that next towelette protruding slightly from the opening 8 so that it can be grasped and pulled when it is wanted, that in turn moving the next succeeding towelette to a position where its leading end can be grasped when desired. Thus under normal circumstances each towelette 16 as it is pulled from the container 2 has been at normal room temperature, and because it is moist, usually because of the presence of highly volatile liquids, it seems quite cool when it is applied to the skin.

The heating attachment of the present invention comprises a mounting means generally designated 18 comprising a horizontal wall 20 which essentially covers the top opening 4 of the container 2, that wall having a depending rim 22 which is detachably, and preferably sealingly, engageable with the upstanding rim 5 of the container 2, and a tube 24 of a length at least equal to a substantial portion of the length of a towelette 16 extends up therefrom, the tube 24 being formed of a suitable heat-transmissive material. The tube 24 is here illustrated as integral with the wall 20, but it may be a separate piece subsequently assembled with the wall 20 in any appropriate manner. The mounting means 18 may be provided with an upwardly facing peripheral groove 26 into which a shell 28 is received, that shell extending up from the wall 20 for a distance slightly less than the length of the tube 24, having a top wall 30 with a central opening 32 through which the tube 24 freely extends with a clearance therebetween, and having an upstanding rim 34 radially outwardly spaced from the tube 24 and extending up approximately to the end of the tube 24.

Mounted on the wall 20 between the tube 24 and the shell 28 is a heating means generally designated 36. In the form here specifically disclosed that heating means 36 comprises an incandescent bulb 38 mounted in a socket 40 secured to the wall 20 in such a way, as by being pivotable about securing screw 42 while the opposite securing screw 44 moves within arcuate slot 46, so that it can be moved toward and away from the tube 24, thereby to vary its heating effect on the contents of the tube 24. Electric wires 48 extend from the socket 40 to a conventional plug 50, the element 52 being an on-off switch which may also, if desired, be provided with a variable control so that the degree to which the bulb 38 is illuminated, and hence the rate at which it produces heat, may be adjusted. A thermostat can also be provided for automatic control of the illumination of the bulb 38 to maintain a desired temperature within the space 51 between the tube 24 and the shell 28, in which space the bulb 38 is received. Heated air in that space can escape through the clearance between the tube 24 and the wall 30 and through openings 35 formed in the rim 34.

While any heating means other than a bulb 38 can be used, the bulb 38 has the advantage of producing light as well as heat, in which case the shell 28 may, at least in part, be of a light-transmissive character, and it may carry appropriate ornamentation either itself or by receiving thereover a light-transmissive ornamented shade 54. Hence the attachment, when mounted on the container 2 or when free standing, can function as a lamp or as a night light in the nursery. The use of a separate ornamented shade 54 permits variation in the decorative effect of the attachment.

Figure 2:
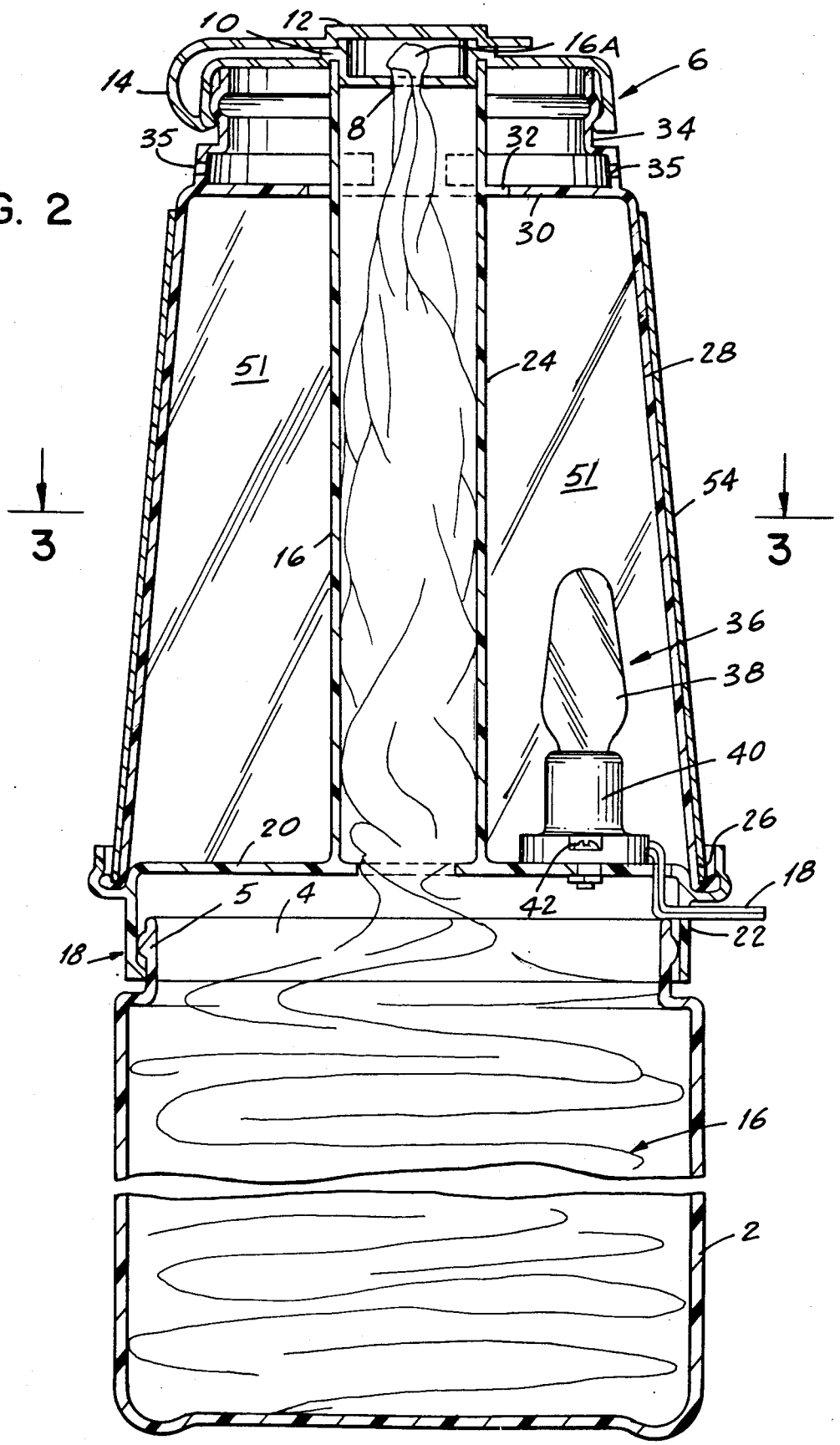
FIG. 2 is a cross-sectional view on an enlarged scale.
Figures 3, 4:
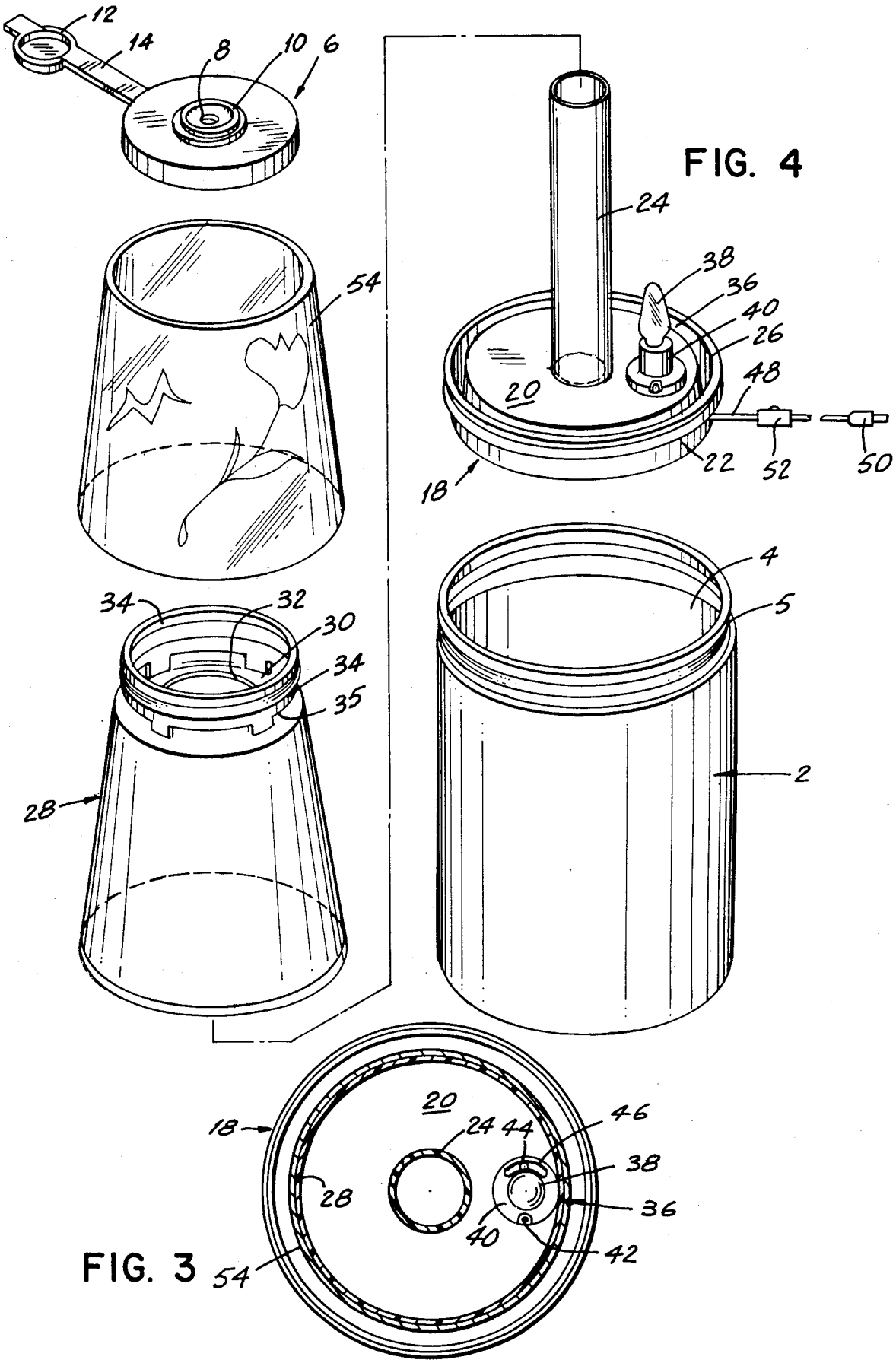
FIG. 3 is a cross-sectional view taken along the line 3—3 of FIG. 2.
FIG. 4 is a three-quarter perspective exploded view of the parts of the illustrated embodiment.

The upper end of the tube 24 is closed by the cap 6 which may be received thereon in the same way that the cap 6 is received on the top of the container 2, the leading end 16A of the leading towelette 16 passing through the opening 8 in that cap 6 so that it can be grasped when the top 12 is swung out from the position shown in FIG. 2 to that shown in FIG. 3. The upper end of the tube 24 and the cap 6 may be considered jointly or severally as the outlet means of the attachment.

As here specifically disclosed the shell 28 and shade 54 are tapered for esthetic reasons, so that their diameters at their upper ends are smaller than those at their lower ends, thus calling for the use of a cap 6 which is smaller than the one which would normally be used on the illustrated container 2. However, if a shell 28 and shade 54 of non-tapered shape were to be employed, the cap 6 that would be used could be the same one that was used for the container 2. When a tapered shell 28 is employed the taper may be such that when the attachment is mounted on a container 2 of large size the cap 6 to be employed would be of the size that the towelette supplier provides on its smaller container.

To use the attachment the cap 6 provided with the container 2 is removed, the leading towelette 16 is partially pulled out and is threaded through the tube 24 and the attachment is mounted on the top rim 5 of the container 2. The appropriate sized cap 6 is then mounted on the top of the attachment, the leading end 16A of the leading towelette 16 being pulled through the opening 8 in the cap 6, and the top 12 of the cap 6 is snapped to its position shown in FIG. 2. The plug 50 is inserted into an appropriate electrical output, the switch 52 is appropriately manipulated, and the device is functional. The heating means 36 provides heat to the space 51 and that heat is transmitted through the tube 24 to the leading towelette 16 the major portion of the length of which is received within the tube. That leading towelette is thus warmed, and hence when the top 12 is moved to its position shown in FIG. 3 and the leading towelette 16 is pulled from the attachment, that towelette will be warm and its application to the baby's skin will be without shock to the infant. At the same time the next towelette 16 will be pulled up through the tube 24 to the position shown in FIG. 2, so it will then be warmed before it is pulled from the attachment.

As here shown the length of the tube 24 approximates the length of a single towelette, so that if a second towelette is removed quickly after the first, that second towelette may not have had time to become fully warmed. Some of the warming effect of the heating means 36 will be transmitted to the interior of the container 2, there to act upon those towelettes closest to being pulled out, so that this problem is usually not a serious one. However, if the tube 24 is further elongated so as to accommodate more than one towelette at a time the heating means 36 can act directly on more than one towelette at a time. Lengthening the tube 24 without increasing the height of the attachment to a corresponding degree can be accomplished, for example, by spiraling the tube 24.

The attachment can be used by itself, without being mounted on a container, as an ornamental object or as a lamp or night light, resting on and supported by its mounting means 18.

The attachment can readily be made of a limited number of simple structural pieces capable of being inexpensively molded of suitable plastic, so that the attachment can be inexpensive and at the same time sturdy enough to be used virtually indefinitely with different towelette containers as the contents of those containers become exhausted.

While but a single embodiment of the present invention has been here specifically disclosed, it will be apparent that many variations may be made in the details thereof, all within the spirit of the invention as defined in the following claims.

I claim:

1. In combination, a container for a plurality of flexible elements, said container having a dispensing station with a first opening through which said elements can be removed, and a heating attachment for said elements comprising mounting means adapted to be secured to said container at said dispensing station so as to communicate with said first opening, outlet means having a second opening through which said flexible elements are adapted to pass, means securing said outlet means to said mounting means in spaced relation thereto, thereby to define a length between said first and second openings through which a flexible element can move, and heating means mounted on said attachment in heat transmissive operative relation to said length, whereby flexible elements are warmed as they are used and move through said length, in which said heating means is mounted to be adjustably movable toward and away from said length, thereby to vary the degree to which said flexible elements are warmed.

2. In combination, a container for a plurality of flexible elements, said container having a dispensing station with a first opening through which said elements can be removed, and a heating attachment for said elements comprising mounting means adapted to be secured to said container at said dispensing station so as to communicate with said first opening, outlet means having a second opening through which said flexible elements are adapted to pass, means securing said outlet means to said mounting means in spaced relation thereto, thereby to define a length between said first and second openings through which a flexible element can move, an enclosure at least partially surrounding said length, and heating means between said enclosure and said length, whereby flexible elements are warmed as they are received in and move through said length, in which said heating means is mounted to be adjustably movable toward and away from said length, thereby to vary the degree to which said flexible elements are warmed.

3. The combination of claim 2, in which said length is at least as long as a substantial portion of the length of one of said elements.

4. The combination of claim 2, in which said heating means is an incandescent bulb, and said enclosure is at least partially light transmissive.

5. The combination of claim 4, in which said length is at least as long as a substantial portion of the length of one of said elements.

6. The combination of claim 2, in which said container is provided with a cap removably attached to cap mounting means at said dispensing station, and said outlet means of said attachment has means for removably receiving said cap thereon to close said second opening.

7. The combination of claim 2, in which said heating means is mounted to be adjustably movable toward and away from said length, thereby to vary the degree to which said flexible elements are warmed.

8. A heating attachment for a container for flexible elements, said container having a wall with a first opening therein through which said elements may be removed, said attachment comprising mounting means adapted to be secured to said container wall at said first opening, outlet means having a second opening through which said flexible elements are adapted to pass, means securing said outlet means to said mounting means in spaced relation thereto, a tube of heat transmissive material extending between said mounting means and said outlet means, communicating with said second opening and adapted to communicate with said first opening, said tube being of a cross-sectional size such as to permit said flexible elements to pass therethrough and of a length at least substantially equal to a substantial portion of the length of one of said elements, a wall surrounding and spaced from said tube to define a space therebetween, and heating means in said space, whereby elements are warmed as they are received in and moved through said tube, in which said heating means is mounted to be adjustably movable toward and away from said tube, thereby to vary the degree to which said flexible elements are warmed.

9. In combination, a container for a plurality of elongated flexible elements, said container having a dispensing station with a first opening through which said elements can be removed and a heating attachment for said elements comprising mounting means adapted to be secured to said container at said dispensing station so as to communicate with said first opening, outlet means having a second opening through which said flexible elements are adapted to pass, means securing said outlet means to said mounting means in spaced relation thereto, thereby to define a length between said first and second openings through which a flexible element can move, a heat transmissive tube enclosing said length through which said elements pass, an enclosure surrounding said length, and heating means between and spaced from said enclosure and said tube for heating the air between said enclosure and said tube, whereby flexible elements are warmed as they are received in and moved through said length.

10. The heating attachment of claim 9, in which said heating means is an incandescent bulb and said wall is at least partially light-transmissive.

11. The combination of claim 9, in which said first opening is larger than said second opening, said mounting means being of a size comparable to said first opening and said tube being of a size comparable to said second opening, said attachment further comprising a wall substantially closing said first opening except for the interior of said tube.

12. A heating attachment for a container for elongated flexible elements, said container having a wall with a first opening therein through which said elements may be removed, said attachment comprising mounting means adapted to be secured to said container wall at said first opening, outlet means having a second opening through which said flexible elements are adapted to pass, means securing said outlet means to said mounting means in spaced relation thereto, a tube of heat transmissive material extending between said mounting means and said outlet means, communicating with said second opening and adapted to communicate with said first opening, said tube being of a cross-sectional size such as to permit said flexible elements to pass therethrough and of a length at least substantially equal to a substantial portion of the length of one of said elements, a wall surrounding and spaced from said tube to define a space therebetween, and heating means in said space between and spaced from said tube and said wall for heating the air between said enclosure and said tube, whereby elements are warmed as they are received in and moved through said tube.

13. The attachment of claim 12, in which said attachment at said outlet means is provided with cap receiving means for removably receiving a cap thereon to close said second opening.

14. The attachment of claim 12, in which said heating means is mounted to be adjustably movable toward and away from said tube, thereby to vary the degree to which said flexible elements are, heated.

* * * * *